US012089734B2

(12) United States Patent
Narke

(10) Patent No.: US 12,089,734 B2
(45) Date of Patent: Sep. 17, 2024

(54) PORTABLE AND MODULAR WORKSTATION SOLUTION

(71) Applicant: Touria LTD, Plymouth Meeting, PA (US)

(72) Inventor: Joseph Narke, Plymouth Meeting, PA (US)

(73) Assignee: TOURIA LTD, Plymouth Meeting, PA (US)

( * ) Notice: Subject to any disclaimer, the term of this patent is extended or adjusted under 35 U.S.C. 154(b) by 0 days.

(21) Appl. No.: 17/521,448

(22) Filed: Nov. 8, 2021

(65) Prior Publication Data

US 2022/0142354 A1 May 12, 2022

Related U.S. Application Data

(60) Provisional application No. 63/110,764, filed on Nov. 6, 2020.

(51) Int. Cl.
*A47B 3/10* (2006.01)
*A47B 3/083* (2006.01)
(Continued)

(52) U.S. Cl.
CPC ..... *A47B 3/10* (2013.01); *A47B 3/083* (2013.01); *A47B 21/04* (2013.01); *A47B 21/06* (2013.01);
(Continued)

(58) Field of Classification Search
CPC ..... A47B 3/10; A47B 3/083; A47B 21/04; A47B 21/06; A47B 2021/066; A47B 2200/008
(Continued)

(56) References Cited

U.S. PATENT DOCUMENTS 1,850,636 A * 3/1932 Schauer ..... A47B 3/10 108/35
4,887,536 A * 12/1989 Teichner ..... A47B 3/10 108/38
(Continued)

FOREIGN PATENT DOCUMENTS

WO 2020036416 A1 2/2020
WO 2020097459 A1 5/2020

*Primary Examiner* — Jose V Chen
(74) *Attorney, Agent, or Firm* — FERENCE & Associates; John W. Goldschmidt, Jr.

(57) ABSTRACT

An improved portable workstation used in connection with external electronic devices and other office and personal equipment such as, for example, a laptop, laptop accessories, tablet, cellular telephone, office supplies and the like, is disclosed. The workstation comprises a first section comprising a first work surface, and a second section comprising a second work surface. The second section is hingedly attached to the first section. The workstation may be placed in an open position and a closed position, such that when in the open position the first and second sections reveal a storage compartment accessible to a user of the workstation. The workstation further comprises a support mechanism, such as legs or other support devices, which is capable of being deployed by the user when the workstation is in the open position, and which support the first and second sections when said workstation is in said open position. The workstation further comprises an internal power and data hub positioned in the storage compartment. to When external electronic devices are attached and/or otherwise in operative communication with the hub, the hub provides electrical power and data and internet access to one or more external communications networks.

1 Claim, 15 Drawing Sheets

(51) Int. Cl.
*A47B 21/04* (2006.01)
*A47B 21/06* (2006.01)

(52) U.S. Cl.
CPC ... *A47B 2021/066* (2013.01); *A47B 2200/008* (2013.01)

(58) Field of Classification Search
USPC ..... 108/38, 35, 34
See application file for complete search history.

(56) References Cited

U.S. PATENT DOCUMENTS 5,660,117 A * 8/1997 Noble ..... A47B 23/043 248/460
6,289,824 B1 * 9/2001 Parker ..... A47B 3/0818 108/115
6,523,485 B1 * 2/2003 Cipolla ..... A47B 37/04 108/14
7,823,517 B2 * 11/2010 Roleder ..... A47B 3/087 108/38
8,188,410 B2 * 5/2012 Dean ..... F24C 1/16 108/115
9,603,428 B1 * 3/2017 Al-Hasan ..... A45C 11/00
9,781,996 B1 * 10/2017 Thompson ..... A47B 21/06
9,980,561 B1 * 5/2018 Constantino ..... A47B 21/02
10,258,143 B1 * 4/2019 Kenyon ..... A47B 3/10
10,638,833 B1 * 5/2020 Brucha ..... H05K 5/0217
2007/0028812 A1 * 2/2007 Dumond ..... A47B 23/04 108/36
2008/0149802 A1 * 6/2008 Chiang ..... A47B 3/083 248/463
2009/0211496 A1 * 8/2009 Davis ..... A47C 4/02 108/50.11
2011/0075337 A1 * 3/2011 Riley ..... A47C 7/727 361/679.21
2013/0119929 A1 5/2013 Partovi
2016/0170402 A1 * 6/2016 Lindström ..... G05B 19/402 700/275
2016/0227919 A1 * 8/2016 Turner ..... A47B 3/083
2016/0227920 A1 * 8/2016 Turner ..... A47B 3/083
2016/0231731 A1 * 8/2016 Carver ..... A47B 21/00
2017/0126174 A1 * 5/2017 Wang ..... H02S 40/38
2017/0135587 A1 * 5/2017 Desroches ..... A61B 5/02055
2017/0141611 A1 * 5/2017 Somers ..... A47B 13/00
2017/0303680 A1 * 10/2017 Glõckl ..... E01F 8/0023
2017/0338677 A1 * 11/2017 Seo ..... H02J 7/0068
2017/0354244 A1 * 12/2017 Lee ..... A61B 5/6891
2018/0035800 A1 * 2/2018 Okeke ..... H04M 1/04
2019/0125074 A1 * 5/2019 Cheng ..... H02J 7/0013
2019/0223586 A1 * 7/2019 Hansen ..... A47C 3/20
2019/0243429 A1 * 8/2019 Rinkinen ..... G06F 1/1613
2020/0268144 A1 * 8/2020 Mehandjiysky ..... A47B 13/081
2020/0383470 A1 * 12/2020 Snowbarger ..... F16B 12/22
2021/0022490 A1 * 1/2021 Averianov ..... A47B 21/007
2021/0245064 A1 * 8/2021 Cragg ..... A45C 9/00
2021/0274928 A1 * 9/2021 Hanks ..... A47B 23/041
2021/0307504 A1 * 10/2021 Lucci ..... A47B 13/02
2021/0318724 A1 * 10/2021 Sung ..... B62B 3/02
2021/0328823 A1 * 10/2021 Tang ..... A47G 23/0225
2021/0330070 A1 * 10/2021 Choi ..... A47B 3/002
2022/0039550 A1 * 2/2022 Shen ..... A47B 19/10
2022/0061519 A1 * 3/2022 Yang ..... G06F 3/041
2022/0069598 A1 * 3/2022 Hobbs ..... H02J 7/0044
2022/0071386 A1 * 3/2022 Hanks ..... A45C 3/02
2022/0092571 A1 * 3/2022 Ahn ..... G07G 1/0018
2022/0211173 A1 * 7/2022 Amos ..... A47B 21/02

* cited by examiner

PORTABLE AND MODULAR WORKSTATION SOLUTION

CROSS-REFERENCE TO RELATED APPLICATION

This application claims priority and benefit from U.S. Provisional Patent Application Ser. No. 63/110,764, filed Nov. 6, 2020, the contents of each of which are incorporated by reference herein in their entireties.

FIELD OF THE INVENTION

The present invention pertains to the burgeoning field of tools facilitating remote and/or mobile work, employee mental and emotional wellness, and indoor and outdoor recreation.

BACKGROUND OF THE INVENTION

The world of business, entrepreneurship, and work/life balance has witnessed multiple shifts forward in recent years, especially in light of the recent marked increase in the percentage of employees working from home and/or while traveling. The current state of available technology and commercial products fall short of meeting the needs of this moment. Working outdoors or other remote indoor or outdoor location currently requires locating or having a power source (battery bank or wall outlet), lugging power cords for each of the user's various devices, a separate wireless charger, a device capable of cellular hot-spotting (such as a portable hotspot, or through cell phone tethering, etc.), and a device capable of repeating a boosted WiFi signal and creating a local hotspot, and all related power and data transmission cables. No all-in-one desk networking and charging solution exists in the technology or among commercially available options. Many of the devices which constitute attempts at such a solution would require independent power sources (using rechargeable batteries, for example) with varying lifespans. In addition, a user would be required to find an area, presumably outdoors, or in another non-traditional workspace, where these types of solutions are most frequently sought, where these devices could all function interconnectedly and also allow the user to connect to remote or offline working capabilities on their primary (laptop, iPad, tablet) and/or secondary (cell phone, tablet, smartwatch) devices. In addition, users seeking a comfortable place and position, as they often do, are currently required to seek out an existing space with a seat and a flat writing or working surface (i.e., a picnic table, cabin, tent), or instead have to sit on the ground with the various devices described above surrounding them.

As indicated above, the options for users seeking a mobile workspace solution, especially one that is feasible for use outside, are extremely limited. These options have several significant disadvantages in common, some of which were noted above. Specifically, the requirement to purchase each of the components of a mobile workspace solution is not only costly and inconvenient, but also creates user issues in accomplishing technical compatibility of the various interactive components. Additionally, the various components typically come with and require: their own types or forms of power sources—either built-in or as an auxiliary tool—all of which have their own means of, and minimum times to, full charge; and cables and cords for interconnection. The physical heft, cumbersome conveying, and multi-step deployment of these elements create inconvenience and require excessive mental energy and planning—defeating the aims of a user seeking a uniform and user-friendly solution suitable for use outdoors.

In addition to the significant drawbacks outlined above, existing portable desk surfaces, and other theoretically possible homemade, converted, or jury-rigged options therefor, are not designed for the express purpose of working outdoors. Such commercial products—either already in existence or repurposed versions thereof—are inadequate and partial solutions for the outdoor and other remote location markets. For instance, desks designed as bed trays or lap desks would require significant alteration for use outdoors and on-the-go, with the closure mechanisms and locks being one example of a currently unavailable necessity for a comprehensive and convenient solution to outside work. The limitations imposed by the varying purposes for which they were designed include awkwardly folding or non-adjustable leg angles and workstation heights, all of which create uncomfortable and often non-ergonomic sitting and working positions (such as cross-legged, kneeling or squatting, haphazard uses of outdoor or other workspace unfriendly furniture, vehicles, or naturally occurring accommodations). Options such as individual leg height adjustments and variable angles and orientations for the desktop are essential for a complete and comfortable solution to facilitate the productivity, freedom, and flexibility that users seek, and employers are increasingly coming to value. Furthermore, such commercial options and ad hoc desk solutions do not allow for desk operation when in a closed, folded state, or in an opened state, but with the legs folded.

Likewise, options in the realm of travel and other existing portable desks are insufficient to meet the needs described. They lack some or all of the features required for practical outdoor or other remote location use, including, but not limited to: mechanisms for folding, collapsing, or otherwise minimizing for convenient transport; means for device and component storage; connectivity and networking features; charging components and connections; a flat surface conducive to, and appropriately sized for, writing, opening and laying flat laptops and other devices, and other activities; the ability to add, remove, and substitute accessories and components, as the user may need; and are composed of durable, washable, environmentally-friendly materials. Finally, current states of technology and trends for working and workspaces give rise to a variety of accessories, ideally with a universal connection point and organized and sized for transport and airline travel, which may include electronic attachments and tools for the user's comfort such as sun shades, chair, hammock, and other seating attachments, magnetic data or power connections and ports, cooling systems, as well as solar and heat based recharging systems. These useful advantages remain unmet for a growing population of users and mobile workers.

As noted herein, current technology and commercial products fail to assist those who seek to establish a comfortable and fully outfitted workspace, without the hindrances, inconveniences and inefficiencies noted above.

SUMMARY OF THE INVENTION

The present invention provides a portable, mobile, and/or modular workstation which accommodates a user in a broad range of remote and unconventional working environments. More specifically, the apparatus is designed to promote remote work in outdoor spaces, allowing users to easily conduct remote work from outdoor and mobile locations. The device merges telecommunications, power delivery and back-up, a mobile work environment, and the outdoors, to create a system capable of fulfilling the needs of a remote worker, and accounting for the blurred line between productivity and traditional notions of a mandatory office environment.

Certain embodiments may comprise an improved portable workstation used in connection with external electronic devices and other office and personal equipment such as, for example, a laptop, laptop accessories, tablet, cellular telephone, office supplies and the like, is disclosed. The workstation comprises a first section comprising a first work surface, and a second section comprising a second work surface. The second section is hingedly attached to the first section. The workstation may be placed in an open position and a closed position, such that when in the open position the first and second sections reveal a storage compartment accessible to a user of the workstation. The workstation further comprises a support mechanism, such as legs or other support devices, which is capable of being deployed by the user when the workstation is in the open position, and which support the first and second sections when said workstation is in said open position. The workstation further comprises an internal power and data hub positioned in the storage compartment. to When external electronic devices are attached and/or otherwise in operative communication with the hub, the hub provides electrical power and data and internet access to one or more external communications networks.

Certain embodiments may comprise an improved portable workstation for use with external electronic devices comprising a first section, a second section hingedly attached to the first section. In this embodiment the workstation may have an open position and a closed position, where the first and second sections form a storage compartment accessible to a user of the workstation when said workstation is in an open position. Such embodiments may also comprise an internal power and data hub positioned in said storage compartment where the hub may provide to external electronic devices electrical power and data and internet access to one or more external communications networks.

Certain other embodiments may comprise a portable workstation for use with external electronic devices comprising a work surface comprising one or more areas for storage of items, and an electronics hub adjacent to the work surface. The hub may further provide to external electronic devices electrical power and data and internet access to one or more external communications networks.

BRIEF DESCRIPTION OF THE DRAWINGS

Unless otherwise stated, drawings are Computer Aided Design (CAD) depictions, dimensions are in inches, and drawings are not to scale.

DETAILED DESCRIPTION OF THE EMBODIMENTS

Figure 1:
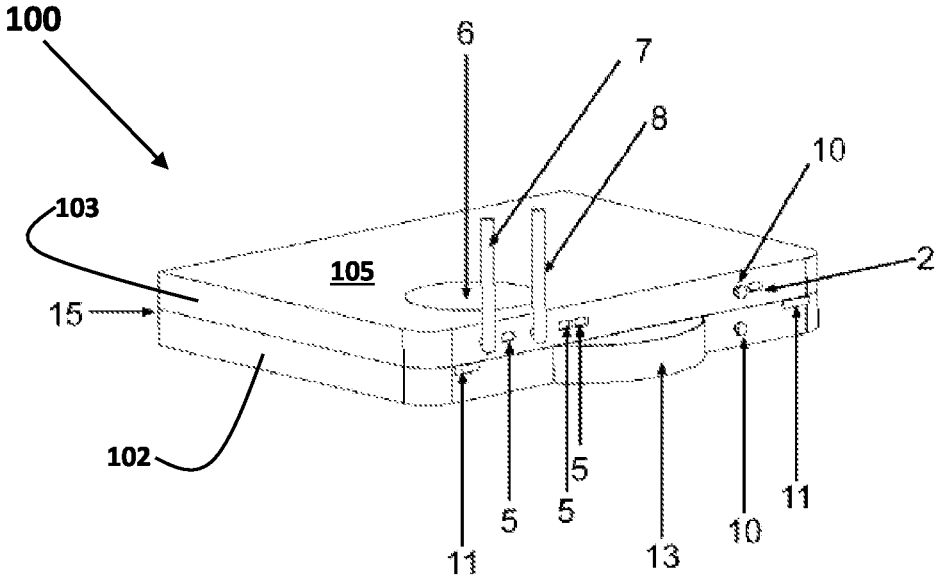
FIG. 1 is a representation of the present invention in a folded and closed position.

The present invention provides a portable, mobile, and/or modular workstation which accommodates a user in a broad range of remote and unconventional working environments. More specifically, the apparatus is designed to promote remote work in outdoor spaces, allowing users to easily conduct remote work from outdoor and mobile locations. The device merges telecommunications, power delivery and back-up, a mobile work environment, and the outdoors, to create a system capable of fulfilling the needs of a remote worker, and accounting for the blurred line between productivity and traditional notions of a mandatory office environment.

The present invention, a portable workstation which provides a complete integrated wireless information technology enabled and ergonomic seating accommodation system, proposes to serve the unmet needs of an increasingly mobile workforce. As described above in the Background Section of this application, multiple disadvantages and deficiencies exist in current options for remote work in unconventional locations, especially outdoors. The present invention combines electronic networking components with a flexible desk top setup suitable for working at various statures and in various positions. Such components can include a large capacity removable battery pack, a cellular network connection, a WiFi network connection, a data or power port switcher, a wireless charger, and any related and expandable accessories, with an objective of compatibility and interoperability of such components with one or more shared connectors and battery sources. A further aim of this technology is to reduce unused materials and batteries, as each component is integrated inside the desk itself, with the least amount of structural housing and technical turnover and replacement possible.

The calculated, ruggedized, and convenient design described herein addresses one or more of the disadvantages of the current technology and specifically resolves an unanswered issue facing remote workers and travelers. Certain aspects of the present invention may comprise one or more of the following features:

- a purposefully-designed desk surface that facilitates a large enough work area for typical telecommunications and remote work with surfaces of a suitable texture on which a user may write, and/or place, position, or stand a laptop or device, of a durable and cleanable material or coating that can withstand repeated outdoor use and travel;
- a foldable structure, with one or more means of securing the components and contents when in its undeployed state, creating a cohesive, all-encompassing, and compact iteration for transportation and storage of the desk itself, and for an internal storage compartment to be created and locked/latched in place when the desk is in its folded state;
- lightweight materials, facilitating undemanding transport and conveyance similar to a briefcase, allowing the desk to be used and transported independently from a backpack or other carrier or luggage;
- multiple useful versions in its convertible forms, which may include one or more of: (1) when completely deployed with legs fully extended; (2) when completely or partially folded, then functioning as a desk or tabletop-like surface; and/or (3) as a telecommunications hub, power source, and/or storage device while partially or completely folded and/or locked;
- the rugged and resilient design, structure, and composite materials of the invention, allowing for uncomplicated transport and use, in tough, dirty, and/or wild outdoor environments;
- adaptable nature of the multiple physical configurations of the invention, including extendable legs, allowing the user to adjust for height, sitting position, angle, and environment, and/or change the angle and height of the usable surface, and/or which further allows for compact storage of the desk when folded, stored and/or stowed; and
- capability of accommodating modules and accessories through connectors and ports, offering the user the ability to customize the workspace and expand functionality, with such ports allowing the user to charge and connect multiple devices through a wired or magnetic connection, connectors enabling attachment of accessories to improve usability in various environments, such as sun shades, privacy screens, chair or other seating, furniture, or fixture mounts, magnetic chargers and/or ports, signal boosters, magnetic accessory attachment points, mats and/or supports, whiteboard, gel hand rests, mousepads, keyboards, cupholders, etc.

Figure 2:
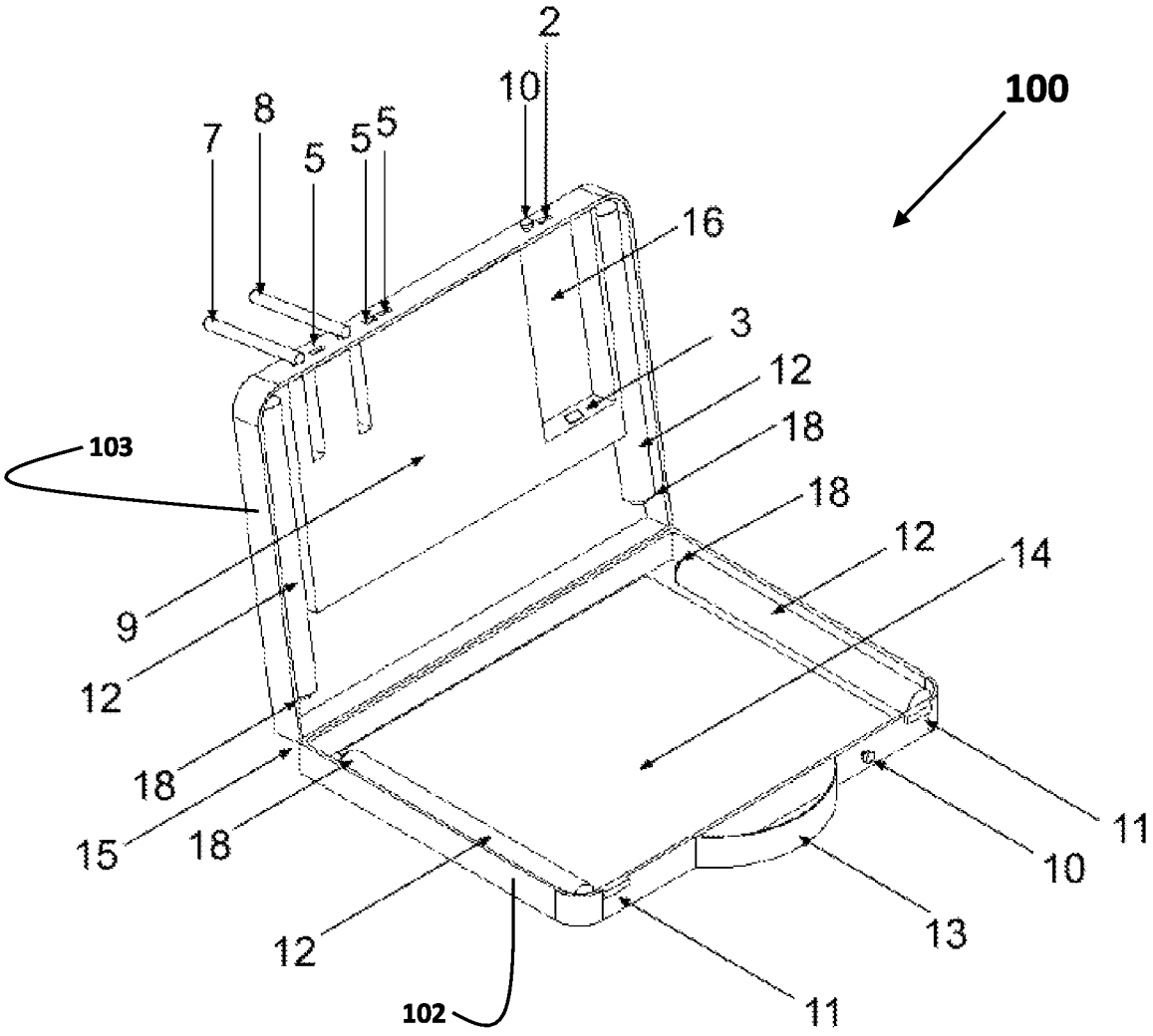
FIG. 2 depicts the partially open, unfolded view of the present invention, showing an interior storage space.

As indicated above, several embodiments and variations of the present invention are contemplated hereby. The present invention is capable of multiple configurations and attendant uses, as demonstrated by the examples in FIGS. 1 and 2, showing the completely folded, shut representation of one embodiment of workstation 100 (in FIG. 1), and a partially open, unfolded form (in FIG. 2), respectively. Certain embodiments of the invention may comprise other configurations of storage and/or in carrying cases, and/or carried through the use of handle 13.

Figure 3:
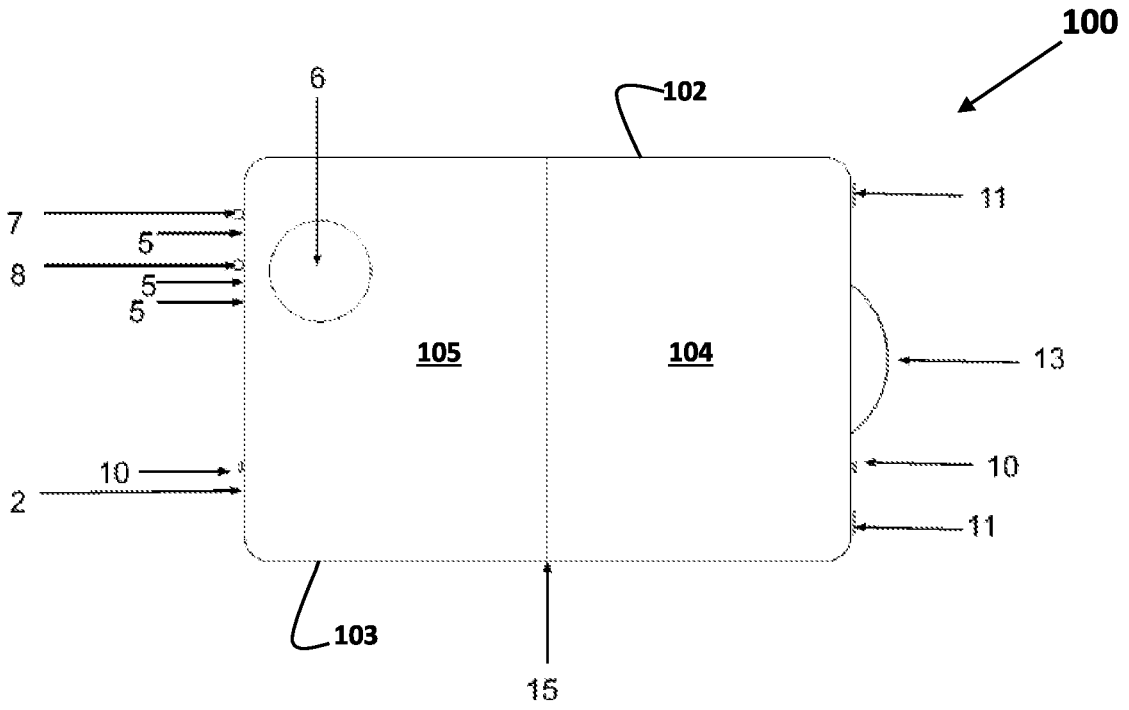
FIG. 3 provides a plan view from above of the present invention in its fully open, deployed position.
Figure 4:
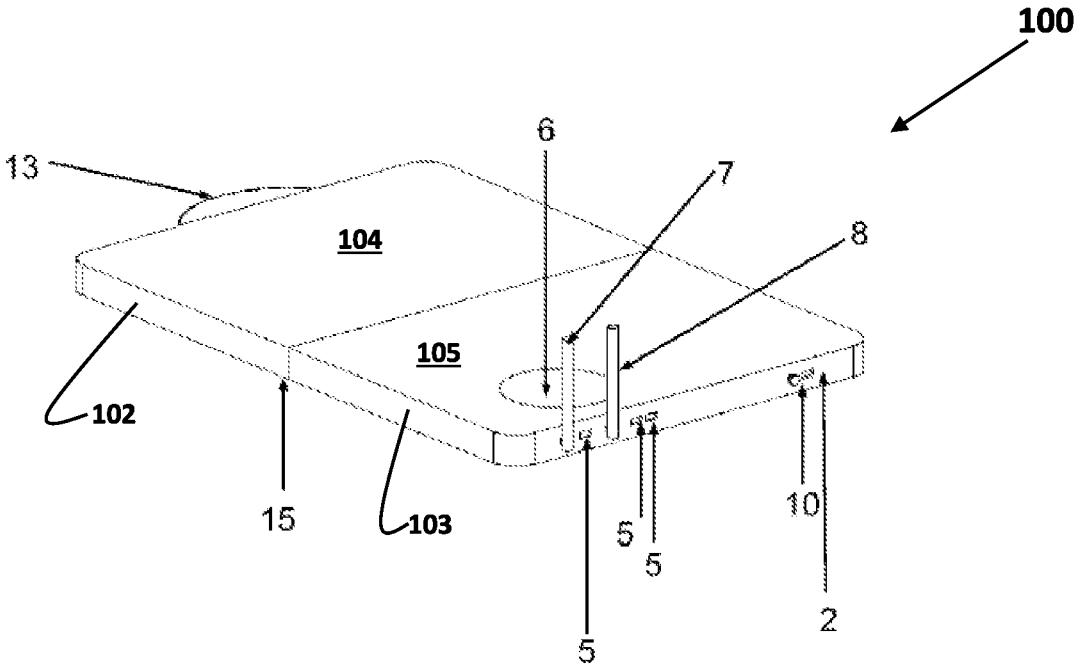
FIG. 4 shows a perspective angled side-view of the invention in its flat, fully open position, demonstrating the relative positions, in such an embodiment, of the handle 13 on one side and various connectivity and input elements on the opposite side.
Figure 5:
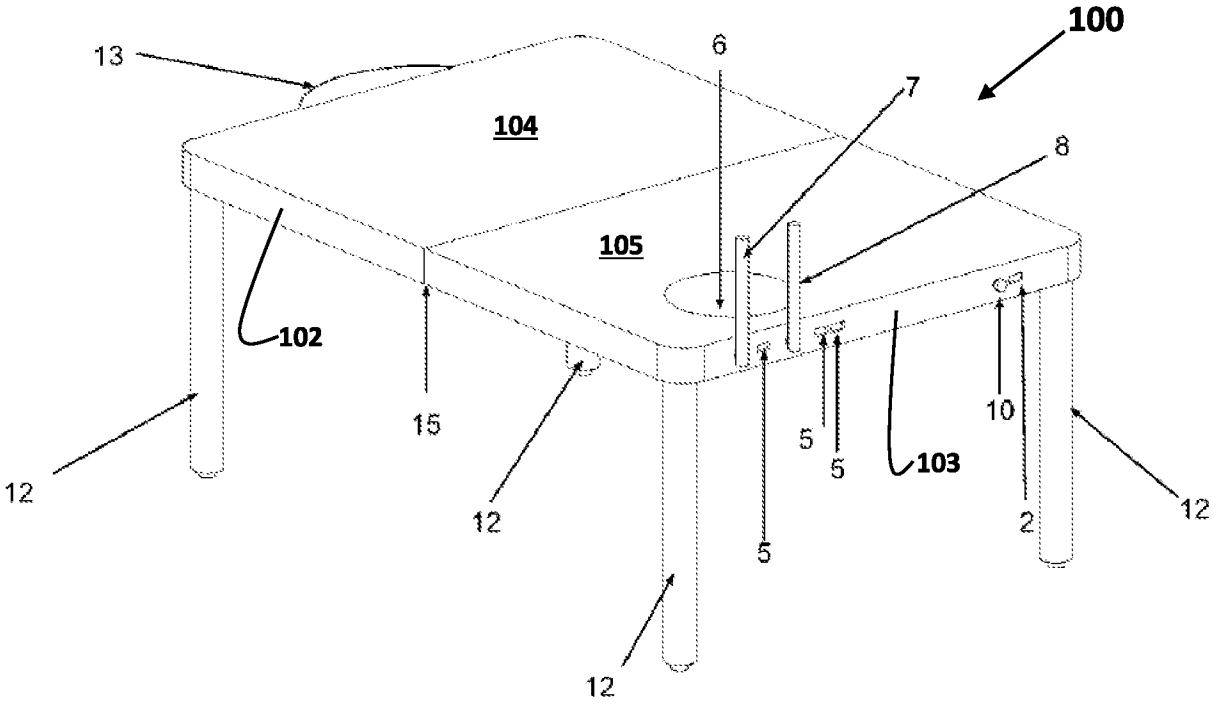
FIG. 5 is an example of the present invention in its open position, deployed for use, with legs unfolded.
Figure 6:
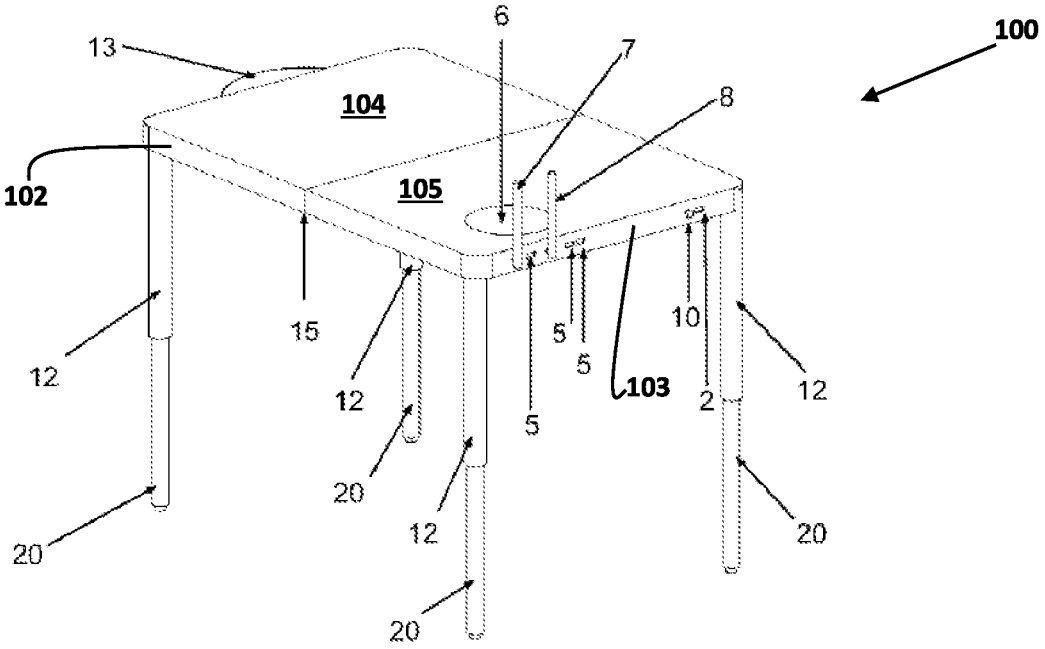
FIG. 6 presents an alternative view of the invention as shown in FIG. 5 with the legs unfolded and extended to show the variation in height available to users.
Figure 7:
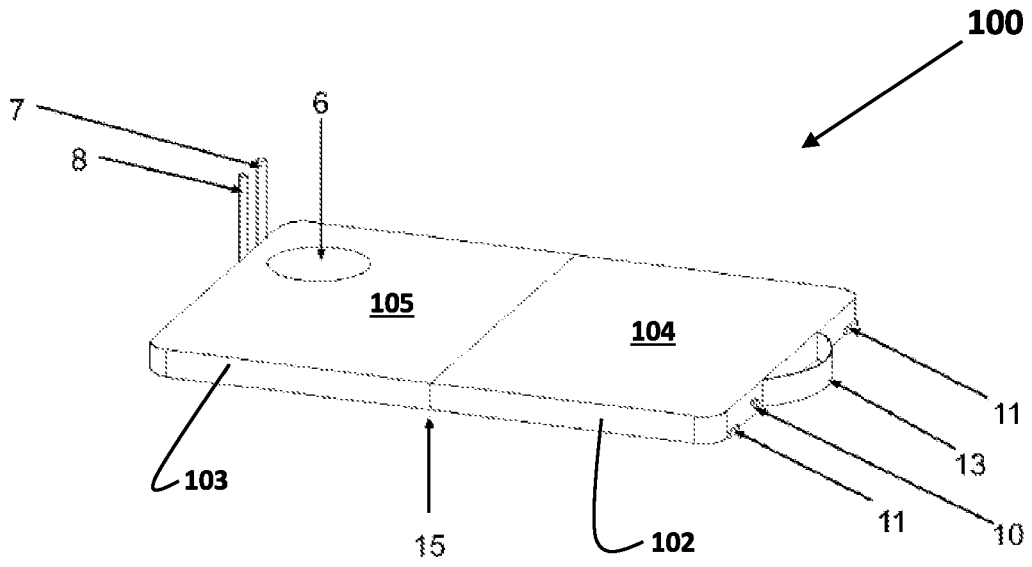
FIG. 7 is an alternative schematic representation of a lateral view of the invention in its flat, open position, with a number of the modular components and their possible relative positions in the embodiment shown.
Figure 8:
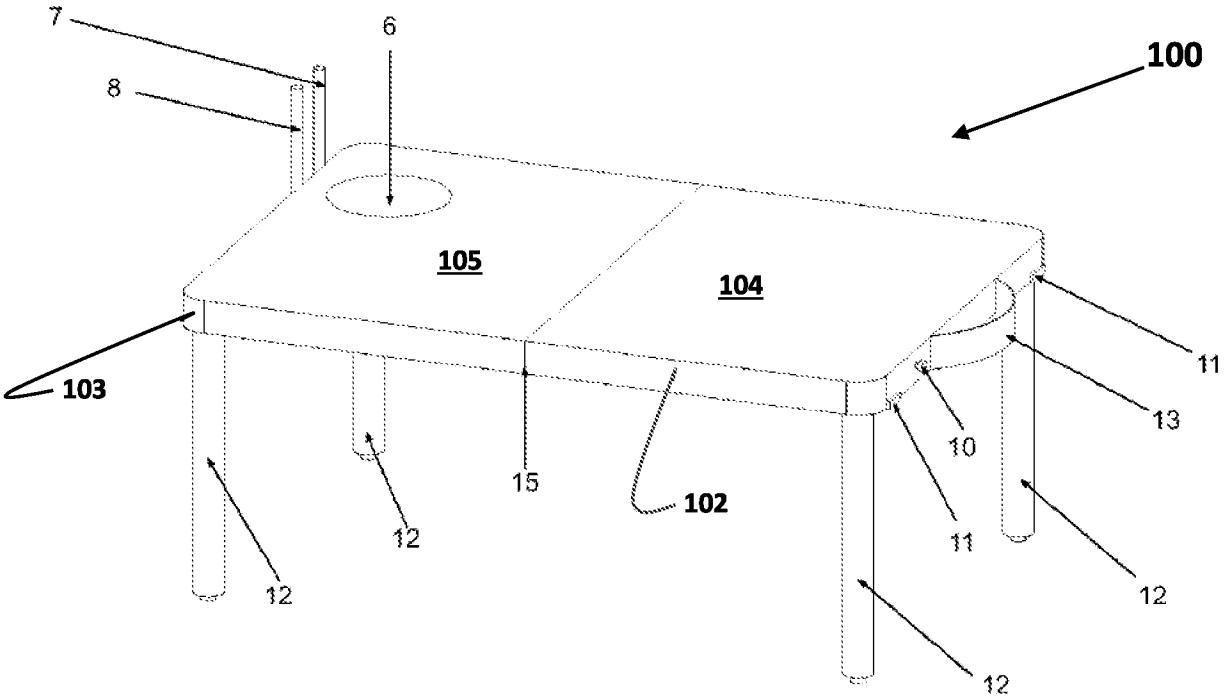
FIG. 8 provides an alternative perspective of the present invention in its open position, deployed for use, with its legs unfolded and standing.
Figure 9:
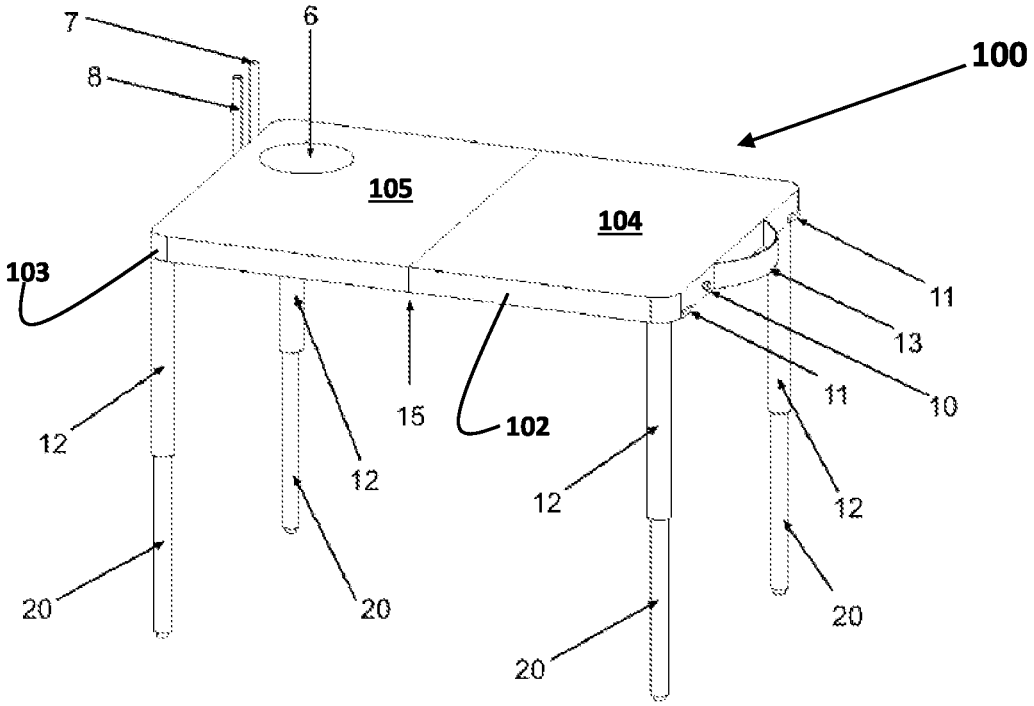
FIG. 9 shows another view of the invention as depicted in FIG. 6, with the legs unfolded and extended to show the variation in height available to users.
Figure 10:
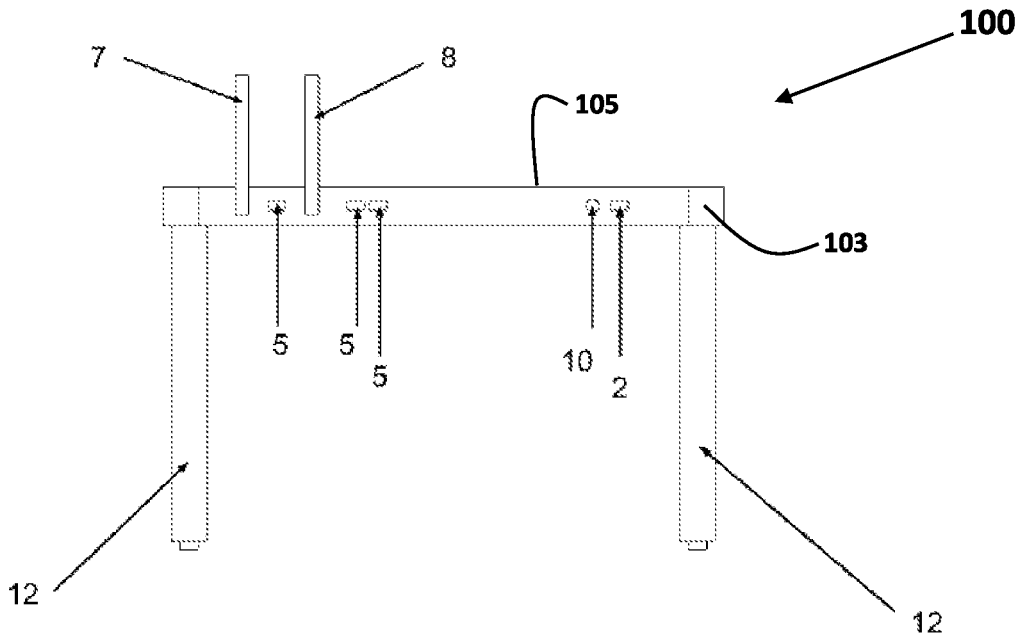
FIG. 10 offers a side view of the present invention in its open, deployed position.
Figure 11:
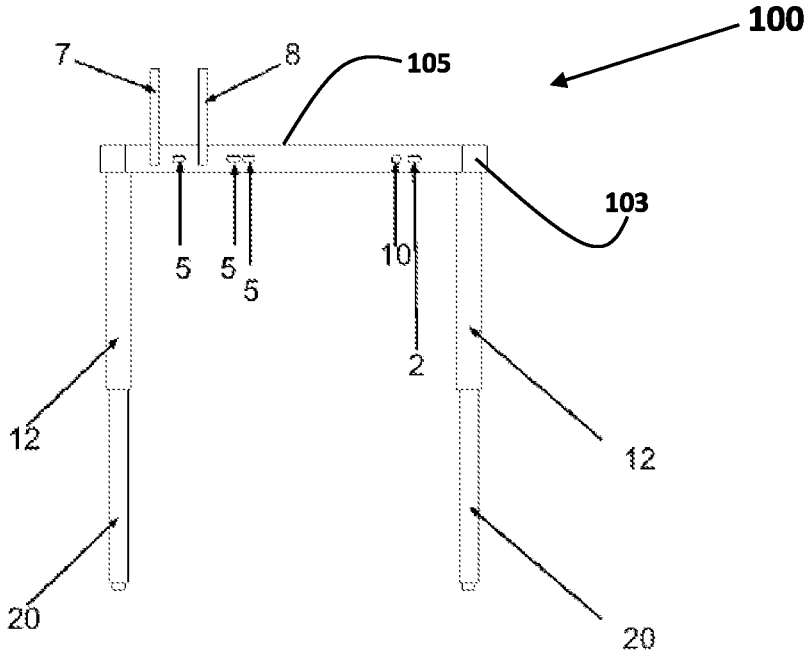
FIG. 11 expands upon the side view of FIG. 10, showing the legs extended, raising the desktop to a height desired by the user, and variable according to such user's preference.

Turning now to FIGS. 1, 2 and 3 there is shown an embodiment of workstation 100 comprising first section 102 and second section 103. First section 102 comprises work surface 104, and second section 103 comprises work surface 105. Workstation sections 102 and 103 of workstation 100 may be unfolded along hinge mechanism 15 into an open or usable position (as, for example, as shown in FIGS. 2 and 3) from its carrying or closed configuration position (as, for example, as shown in FIG. 1), via hinge mechanism 15 and latching, releasing and/or securing mechanism 11 designed to hold sections 102 and 103 together (such as, for example, via a spring loaded locking or latching mechanism).

Any items carried onboard or inside workstation 100 (such as, for example, a laptop, laptop accessories, tablet, cellular telephone, office supplies and the like) may be removably stored in carrying compartment 14. Compartment 14 may also comprise other areas which may be incorporated into workstation 100, or take the form of any type of storage device incorporated into workstation 100 capable of providing onboard storage and/or transport of external electronic devices, peripherals, office supplies and personal items.

Once workstation 100 is in the open position (as, for example, as shown in FIGS. 2 and 3), a support mechanism, such as for example extendable legs 12, may be deployed, unfolded and/or extended to a proper or desired length. Support mechanism 12 is intended, at least in part, to provide support to sections 102 and/or 103 and/or work surfaces 104 and/or 105 when workstation 100 is in the open position.

If a battery is not present in battery slot 16, a removable battery may be inserted into battery slot 16.

One or more wireless WiFi connection(s) 7 and/or cellular data connection(s) 8 may be provided, accessed, switched on and connected to a device (such as for example a laptop computer, cellular telephone, tablet, smartwatch or other electronic device or peripheral) by a user of workstation 100. WiFi and/or cellular data connections 7 and 8 also may comprise appropriate antenna devices.

Cabled power also may be provided to a device (such as for example a laptop computer, cellular telephone, tablet, smartwatch or other electronic device or peripheral) through weatherproof magnetic connection ports 5 or a wireless charger 6. Any electronic devices or accessories also may be attached and/or connected through the universal connectors 10 to access battery power and/or WiFi and/or cellular data.

When a user is finished using workstation 100, items intended to be stored and/or transported inside workstation 100 may be placed, stored and/or transported in storage compartment 14. Extension legs 12 may be unextended and/or folded and stored inside of workstation 100. To place workstation 100 in a closed position, two halves 102 and 103 may be folded along hinge 15 and latched together via latching mechanism(s) 11. Workstation 100 may then be transported and/or carried in the closed position using handle 13.

A removable battery pack or other power source (not shown) may also be mounted to Workstation 100 at removable battery slot 16. When so equipped with a power source, workstation 100 may be capable of charging battery powered devices (such as for example laptop computers, cellular telephones, tablets, smartwatches or other electronic devices or peripherals) via port 2. The removable battery or other power source may be operatively connected internally to workstation 100 via designated connection point 3, therein operatively connecting the power source to port 2. Thus, when a battery powered device (such as for example laptop computers, cellular telephones, tablets, smartwatches or other electronic devices or peripherals) is operatively connected to port 2, the battery powered device may be charged by the power source.

The invention may also comprise internal hub system 9 that enables power and data transfer to external electronic devices (such as for example laptop computers, cellular telephones, tablets, smartwatches or other electronic devices or peripherals) in operative communication with one or more port(s) 5 and/or 6. In certain embodiments, connection to port(s) 2 and/or 5 may magnetically or otherwise be attached in operative communication with external electronic devices. Hub 9 also may provide a centralized interface to wireless charger 6. Additionally, hub 9 may provide a centralized interface in operative communication with WiFi signal booster and hotspot network system 7, and/or cellular data connection 8.

In certain embodiments, workstation 100 comprises a removable battery pack which confers the ability to charge an entire laptop or one and/or more electronic devices at a reasonably expedient charging rate. In addition, the battery pack may be capable of being removed for added portability. This feature provides users of workstation 100 who work outdoors or in other remote or unconventional venues with a power source, connectivity to the internet and/or other data and/or networking sources, as well as a portable work surfaces 104 and 105. In addition, the removable nature of the battery pack allows for the use of the battery pack independent of workstation 100, and the capability of replacement of expended battery packs, and/or allowing for exchange of battery packs with battery packs of differing charging capacity including but not limited to larger or smaller charging capacities. The ability of the battery to charge and accept/divert power from power sources, such as AC connections, solar chargers, heat charger, other batteries, etc., enable workstation 100 to be used in remote environments where grid energy is not readily available. Moreover, the ability to exchange battery packs of differing types and capacities allows for safe and legal travel in compliance with regulatory requirements, and particularly with airline and other travel regulations.

In certain embodiments, cellular network connection and system 8 allows the user to connect to a cellular network funneling through a sim card, independent of other devices such as cellphone tethering. Cellular connection 8 of this type may facilitate mobile telecommunications capabilities, allowing the user to use the product away from a traditional home or office setting, and supports enhanced privacy and security measures compared to public wireless connections. The modular nature of cellular network connection 8 may allow the user to use external electronic devices (such as for example laptop computers, cellular telephones, tablets, smartwatches or other electronic devices or peripherals) independently from workstation 100.

In yet another embodiment, wireless network extender and hotspot system 7 of the present invention can expand the WiFi range for networked external devices (such as such as for example laptop computers, cellular telephones, tablets, smartwatches or other electronic devices or peripherals), allowing the user to network in environments without needing to be in relatively close proximity to a wireless router/network, and enabling use in remote locations such as a backyard, park, patio, etc. Additionally, the wireless hotspot 7 allows for privacy when connected through a public network, keeping business and personal information secure. The modular nature of this wireless network connection 7 allows the user to use external electronic devices (such as for example laptop computers, cellular telephones, tablets, smartwatches or other electronic devices or peripherals) independently from workstation 100.

In certain embodiments of workstation 100, wireless charging feature 6 facilitates convenient and uncomplicated charging of electronic devices, eliminating the need for a wired connection to the battery and giving the user several options for ergonomic placement and usability of a device placed, for example, on one or more of surfaces 104 and/or 105 of workstation 100.

Figure 15:
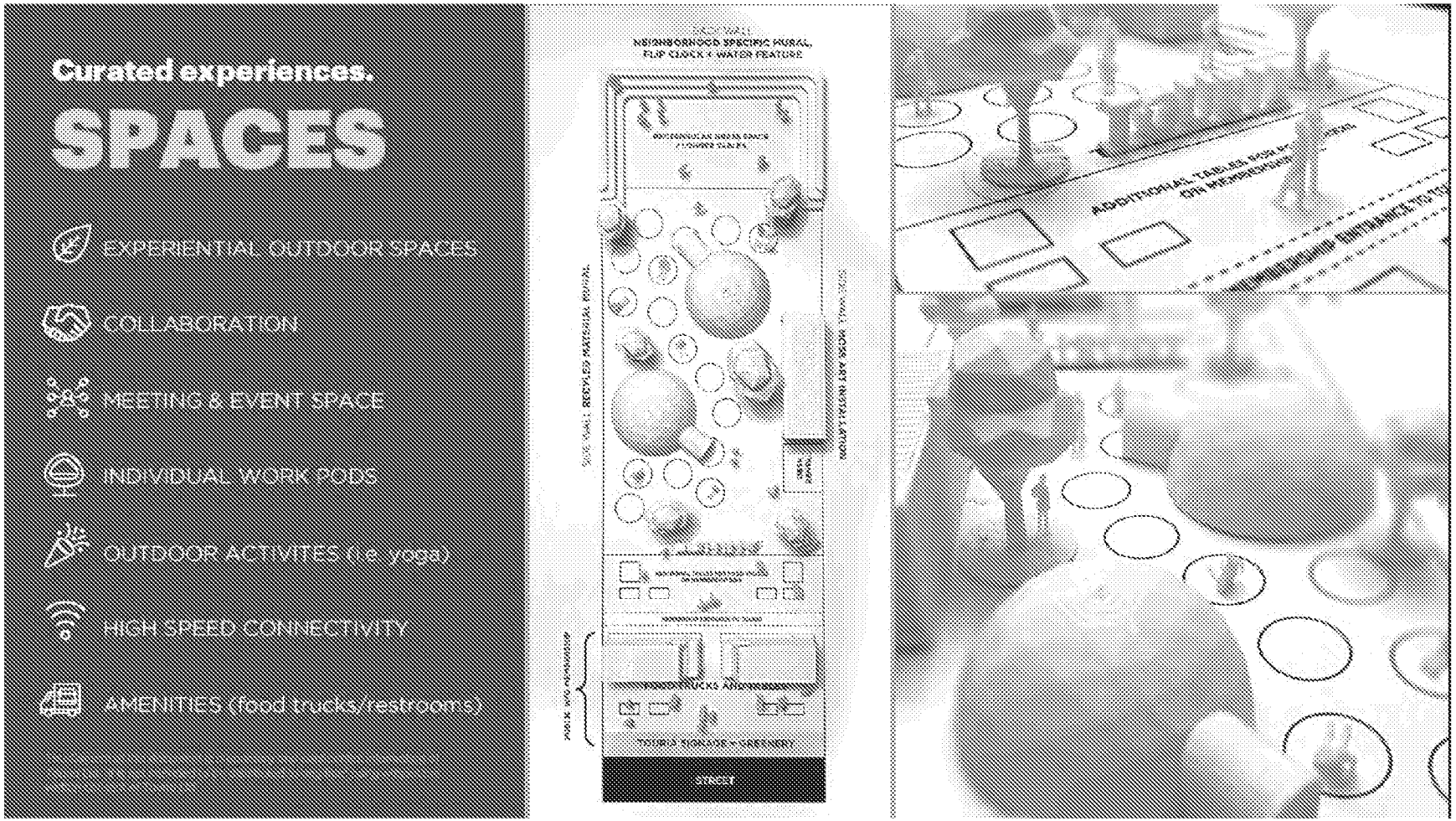
FIG. 15 depicts a physical ecosystem and/or community comprising an indoor and/or outdoor collective of persons using one or more workstations of the present invention.

In certain embodiments, such as depicted in FIG. 15, workstation 100 may form a connection between a user of workstation 100 and a community of an indoor and/or outdoor collective, bringing people with or without workstations 100 into a physical ecosystem to collaborate or otherwise interact via one or more workstations 100. In addition, working in such collectives comprising one or more workstations 100 may provide mental and emotional health benefits, awareness, environmentally conscious work schedules, spaces, and routines, and hybrid work.

The present invention is more fully described by way of the following non-limiting examples, use cases and objects of the invention, which should, in no way, be construed as limiting the scope of the invention. The goals accomplished by this invention are increased efficiency, cost-savings, fewer incidents of technical difficulty or failure, promotion of mental health, mindful enjoyment of the outdoors, work/life balance, professional freedom and flexibility, and multiple positive environmental impacts. Its largest role will be in the professional, home office, and travel spaces, with applications in every industry and arena of work, and appeal to individual end users, as well as large employers and businesses.

Several use cases are described in, or contemplated by, this application wherein users customize their preferred uses of mobile workstation 100, capable of being integrated with modular wireless communications, such as WiFi connection(s) 7 and/or cellular data connection(s) 8, and battery power devices for enabling a fully integrated workstation 100 unit, or used independently of workstation 100, but when connected to workstation 100 provides power and functionality to workstation 100 for use by external electronic devices (such as for example laptop computers, cellular telephones, tablets, smartwatches or other electronic devices or peripherals).

In one example of the utility and practical advantages represented in the various embodiments, workstation 100 provides a portable, all-in-one office system that affords a convenient, portable, modular, and productive office experience for use in an indoor and outdoor (or other remote and non-traditional) location, and then workstation 100 collapses into a compact form for ease of transport.

One or more of the foregoing embodiments may be adapted to or with a customized or non-customized backpack, carrying case or bag.

Furthermore, one or more of the embodiments of workstation 100 provided herein may be utilized in the use case of a mobile workstation sharing network, which may be focused in a particular venue or location, such as Central Park, or deployed within a city or other larger geographic region, and wherein an iteration of the present invention can be rented from a bank of containers or lockers and employed by the user according to such user's requirements, and then returned after use to its locker of origin or another bank of lockers or containers located elsewhere for charging and other potential restorative treatments, such as redistribution, recycling, disinfecting, or other post use processing or handling.

In another embodiment, certain embodiments of workstation 100 may comprise a mobile workstation which provides an integrated wireless information technology enabled and ergonomic seating accommodation system, for users in remote, outdoor, or other locations and settings, such as construction sites, work zones, and on-the-ground research or military locations.

Figure 12:
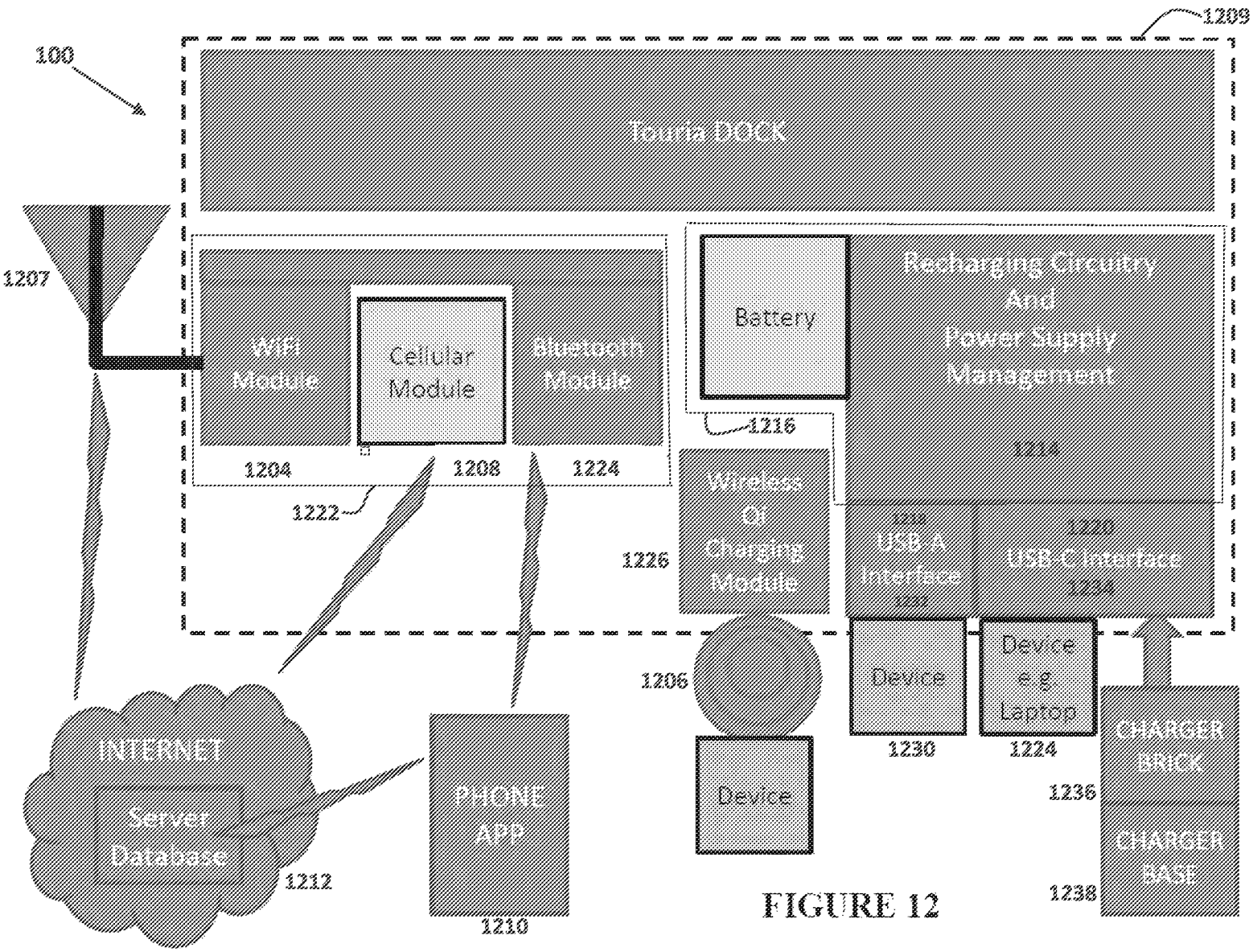
FIG. 12 depicts a block diagram of one embodiment of the electronics hub of the workstation of the present invention.
Figure 13:
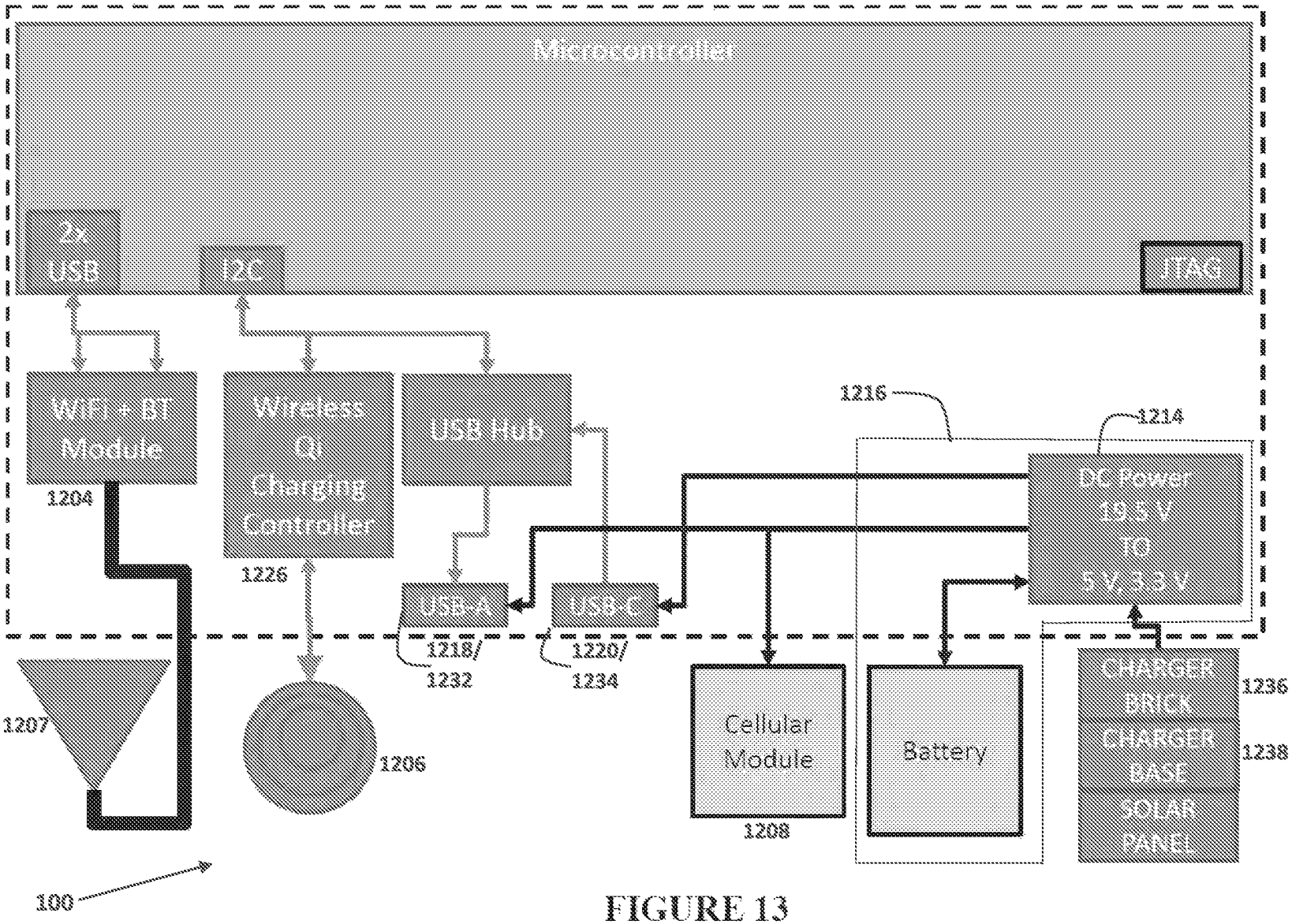
FIG. 13 depicts a block diagram of another embodiment of the electronics hub of the workstation of the present invention.
Figure 14:
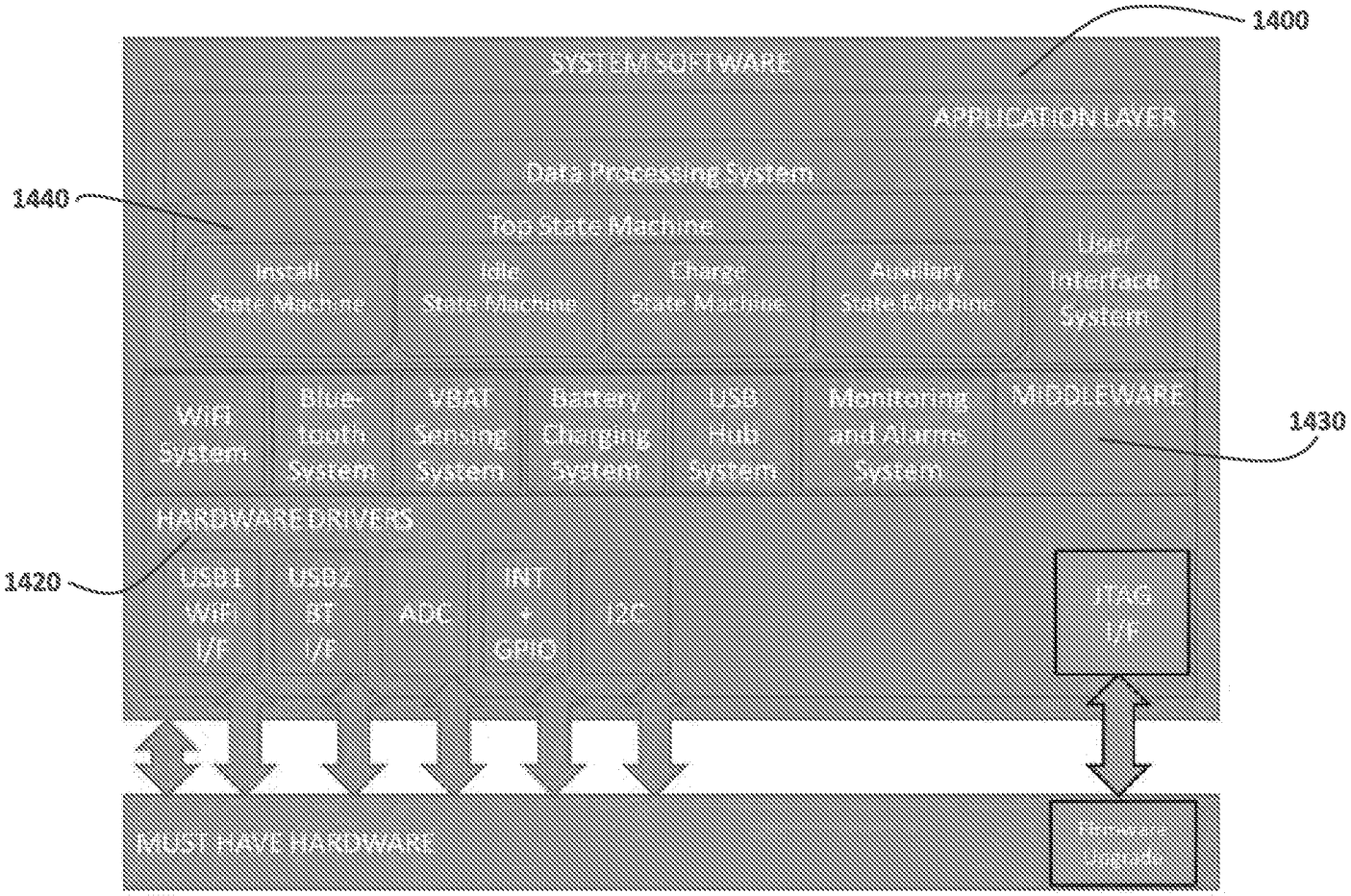
FIG. 14 depicts a block diagram of the system software of one embodiment of the workstation of the present invention.

Turning now to FIGS. 12, 13 and 14, Workstation 100 "DOCK" device may comprise a unit capable of providing a multipurpose on-demand working surface (such as, for example, surfaces 104 and 105 as shown in FIG. 3), power and networking interfaces (such as, for example, wireless charger 6 and WiFi connection 7 and/or cellular data connection 8, respectively, as shown in FIG. 1), and/or storage of external devices and supplies (such as, for example, in storage/carrying compartment 14 as shown in FIG. 2). In such embodiments, Workstation 100 may comprise a hardware/firmware hub 1209 comprising Internet connectivity 1204 and battery power supply 1216.

Certain embodiments of workstation 100 comprise a cost-effective device that comprises a multipurpose working surface (such as, for example, work surfaces 104 and 105 depicted in FIG. 3). Such embodiments of workstation 100 enable users to have a mobile working platform and/or surface. In addition, certain embodiments of workstation 100 may also comprise a storage and/or on-board carrying compartment (such as, for example, storage compartment 14 depicted in FIG. 1) that may be used for storage of, by way of non-limiting example, computer laptops, computer workstations, computer accessories, computer tablets, cellular telephones, office supplies and the like. Also, certain embodiments of workstation 100 may also comprise energy storage (such as batteries) and charging facilities as well as Internet connectivity for laptops and other computer and electronic devices. Certain embodiments of workstation 100 may comprise DOCK hub 1209, smart phone app 1210 to be used as a user interface, and with connectivity to cloud infrastructure 1212.

In one embodiment, DOCK 100 may comprise a single enclosure packaged unit with a footprint of about 16×12×1 inch (for electronics). DOCK 100 may be powered via a laptop-like power connector(s) 1218 and/or 1220 from a commercial AC/DC converter that outputs DC power (for a lap-top). Therefore, in certain embodiments DOCK 100 may not draw more than about 5.13 A of current through power supply 1214. DOCK 100 may also have WiFi (802.11ac-IPV6) 1204 and cellular (IPV6) 1208 connection to Internet 1212.

Certain embodiments of workstation 100 may comprise one or more of the following features:

a) DOCK 100 may be a workstation that is geared towards supporting computer laptops and/or tablets used to perform typical office tasks (meetings, teleconferencing, typing, studying, etc.);

b) DOCK 100 may comprise a surface, such as surface(s) 104 and/or 105, and may accommodate a typical business laptop, as well as have room for using, supporting and/or storing additional peripherals (e.g. mouse, notepad, coffee, etc.);

c) DOCK 100 may fold into a storage device (in some embodiments similar to the modern-day briefcase) capable of carrying a standard business laptop and several accessories/chargers/etc.;

d) Power source 1216 may have a capacity of about 26800 mAh limit;

e) Power source 1216 may charge a laptop at a rate of about 60 W-100 W;

f) Power source 1216 may charge and power primary and ancillary devices (phone, headphones, accessories, tablet, etc.) through the inside and outside ports, while being charged through an outside port;

g) DOCK 100 may be used with a Wi-Fi with external antenna 1207 and/or a cellular (4G/LTE) data connection 1208;

h) Wi-Fi and cellular hotspot 1222 may be set up via a local controller connected to phone app 1210 via BLE;

i) Cellular hotspot 1208 may comprise a sim card tray for operation;

j) Cellular hotspot 1208 and Wi-Fi module 1204 may be able to connect any number of external devices;

k) Cellular hotspot 1208 may be used independently of DOCK 100 and may be added, removed, and locked into DOCK 100;

l) External devices and electronics may be powered through an on-board power source (e.g. Power source 1216);

m) DOCK 100 may feature USB A and/or USB C port(s) 1218 and/or 1220 inside and outside that provides power sources to external devices;

n) DOCK 100 may feature a flat wireless charger 1206 capable of charging a phone, computer tablet, and/or accessories such as headphones;

o) DOCK 100 surface(s) 104 and/or 105 may be cleanable, outfitted with magnets to attach covers, and smooth enough for writing tasks;

p) DOCK 100 may support integration into a home-based charging "station;"

q) DOCK 100 may comprise internal storage 14 and/or power, Internet and Bluetooth connection points for accessories; and/or r) DOCK 100 may latch 11 when it is in briefcase mode (e.g. FIG. 1) to prevent access to interior storage area 14.

One embodiment of Workstation 100 comprises DOCK unit 1209 and may continuously monitor user input via network interface 1204, and/or or via the Bluetooth interface 1224. Installation and connection to network 1212 may be via WiFi 1204, and/or cellular 1208. DOCK 100 may be about 16×12×2 inches to afford easy transportation and placement in the home or office while taking up the least amount of space.

In one embodiment, the operational requirements of Workstation 100 may comprise one or more of the following features:

Interfaces:

Inputs:

Human Interface: In certain embodiments of workstation 100, the human interface of the DOCK device 1209 may be provided via a Bluetooth connected smart phone app 1210.

DC Power: Power may be applied via a laptop-like connector 1224.

Wireless: WiFi 802.11ac-PV6 1204 and cellular—IPV6 1208.

Outputs:

Human Interface: In certain embodiments of workstation 100, the human interface of the DOCK 1209 device may be provided via a Bluetooth connected smart phone app 1210.

DC Power: Power may be applied via a laptop-like connector 1224.

Wireless: WiFi 802.11ac-PV6 1204 and cellular—IPV6 1208.

Wireless Charging: Qi Wireless Charging Standard 1226.

Embedded System Features:

Charging the Battery:

Workstation 100 may have the ability to charge an on-board Li+ or LiPo battery 1228 with a capacity of up to about 26800 mAh.

USB Dongle:

Workstation 100 may provide USB dongle functionality from USB-C port 1234 as device to USB-A port 1232 as host.

Wireless Charging:

Workstation 100 may provide wireless charging functionality employing the Qi wireless charging standard 1226.

Bluetooth Communications:

Workstation 100 may provide Bluetooth communications 1224 to communicate with Phone App 1210 using a Transparent UART Profile.

WiFi Communications:

Workstation 100 may provide WiFi router 1222 functionality.

Upgrading:

Firmware (such as, for example, Firmware 1400 shown in FIG. 14) upgrades to Workstation 100 may be made through Bluetooth connection 1224 of Phone App 1210, and appropriate indication of such upgrade(s) may be provided to the user.

Power Consumption:

Main power to the DOCK 100 may be provided by power supply brick 1236 like those used for laptops. DOCK 100 may supply power to a removable Cellular Hotspot.

Certain embodiments of Workstation 100 may meet necessary and/or desirable FCC and environmental regulatory requirements.

In FIG. 13 there is shown a block diagram of another embodiment of workstation 100 of the present invention.

In FIG. 14 there is shown a block diagram of one embodiment of system software 1400 of workstation 100. In certain embodiments, system software 1400 may control and/or manage the various functions of workstation 100 such as power supply and/or charging capability to external devices, Internet connectivity, WiFi and/or Bluetooth network access and/or connectivity. System software 1400 may comprise one or more of software, firmware and/or hardware to manage and/or control the functionality of systems and devices present in and in connection with certain embodiments of workstation 100 of the present invention.

Turning now to FIG. 14, workstation 100 may comprise system software 1400 in operative communication with workstation 100. system software 1400 may comprise any combination of software, firmware and/or hardware which may be written and commented so that it is easy to understand and maintain. In certain embodiments, system software 1400 may be integral to or in operative communication with hub 1209.

System software 1400 may be written in industry standard language or "C" code. Any special libraries or software functions not provided with standard compilers may be identified and implemented into system software 1400.

In certain embodiments of workstation 100, system software 1400 may be organized in three layers as shown in FIG. 14. Lower layer 1420 may provide direct software drivers for the hardware. Middle layer 1430 may provide operating system and/or system like functionality. Top layer 1440 may provide the actual overall functionality of the system on top of middle layer 1430 (which also may be referred to herein as Middleware 1430). In certain embodiments, top layer 1440 may comprise one or more of application, data processing, machine, and/or user interface operational control systems.

Turning now to FIG. 15, there is shown one embodiment of a physical ecosystem and/or community comprising an indoor and/or outdoor collective of persons using one or more workstations of the present invention. Such embodiments exemplify the type of living and working environments in which workstation 100 may be utilized. One or more workstations 100 may be utilized in indoor and/or outdoor spaces to enhance collaboration between individuals, to provide environments for meeting and/or event spaces and/or other indoor and/or outdoor activities. Individual workspaces such as work pods, cubicles, offices and the like may be incorporated into such environments in which workstations 100 may be employed. Access to internet, WiFI, Bluetooth and cellular networks may also be provided for connectivity with workstations 100 in such environments. In addition, amenities and conveniences (such as for example food and beverage, restrooms, lounges, entertainment and the like) may also be incorporated into such environments which workstations 100 are utilized.

The disclosure herein is directed to the variations and modifications of the elements and methods of the invention disclosed and that will be apparent to those skilled in the art in light of the disclosure herein. Thus, it is intended that the present invention covers the modifications and variations of this invention, provided those modifications and variations come within the scope of the appended claims and the equivalents thereof.

What is claimed is:

1. A portable workstation for use with external electronic devices comprising:

a first section comprising a first work surface;

a second section comprising a second work surface, said second section hingedly attached to said first section, said workstation having an open position and a closed position, and said first and second sections forming a storage compartment accessible to a user of said workstation when said workstation is in said open position;

a support mechanism which is capable of being deployed by said user when said workstation is in said open position, and which supports said first and second sections when said workstation is in said open position; and an internal electronics hub comprising one or more of WiFi, cellular, Bluetooth, and power supply modules positioned in said storage compartment, said hub providing to said external electronic devices electrical power and data and internet access to one or more external communications networks; and an on-board operating system in operative communication with said hub, said operating system comprises system software in operative communication with said hub and a top layer, a middle layer and a lower layer which layers provide one or more of application, data processing, machine, and/or user interface operational control systems.

* * * * *